US006347722B1

(12) United States Patent
Fenlon

(10) Patent No.: US 6,347,722 B1
(45) Date of Patent: Feb. 19, 2002

(54) PACIFIER DISPENSER

(76) Inventor: Gregory F. Fenlon, 6715 Maybole Pl., Temple Terrace, FL (US) 33617

( * ) Notice: Subject to any disclaimer, the term of this patent is extended or adjusted under 35 U.S.C. 154(b) by 0 days.

(21) Appl. No.: 09/544,402

(22) Filed: Apr. 6, 2000

(51) Int. Cl.[7] ..... B65H 3/28
(52) U.S. Cl. ..... 221/221; 221/308
(58) Field of Search ..... 221/33, 45, 46, 221/63, 103, 221, 303, 308, 310, 1, 438; 206/438, 527

(56) References Cited

U.S. PATENT DOCUMENTS

| | | | | |
|---|---|---|---|---|
| 2,164,406 A | 7/1939 | Hope | ..... | 312/43 |
| 2,584,941 A | 2/1952 | Taubert | ..... | 312/43 |
| 4,199,076 A | 4/1980 | Brown | ..... | 221/45 |
| D304,535 S | 11/1989 | White | ..... | D6/516 |
| 5,607,452 A | 3/1997 | Michaud | ..... | 606/234 |

FOREIGN PATENT DOCUMENTS

| | | |
|---|---|---|
| EP | WO 83/02441 | 7/1983 |

*Primary Examiner*—Kenneth W. Noland

(57) ABSTRACT

An apparatus comprising a dispenser having a flanged tubular container removably engaged in a bracket. The container has an interior space for holding pacifiers and a flexible gasket at the bottom of the container to retain the pacifies in the container. The pacifiers are placed in the container with the nipple facing downward. The body of the pacifier is held inside the container by the gasket. By grasping the pacifier at the side openings of the container and pulling downward, he gasket will deform and the pacifier will be released from the container. The gasket will return to its original shape and the next pacifier will be held until needed The bracket may be fixedly mounted to a wall or it may be attached to a crib by a pair of velcro straps.

6 Claims, 3 Drawing Sheets

PACIFIER DISPENSER

BACKGROUND OF THE INVENTION

1. Field of the Invention

The present invention relates to an apparatus for holding multiple pacifiers and more specifically, to a container and bracket for retaining a plurality of pacifiers for access by a parent or child.

2. Description of the Prior Art

Many parents provide pacifiers to their children during early childhood. Pacifiers are used to calm the child. A problem associated with pacifiers is that the device is lost by the child during a nap or at night during sleep. In addition, the pacifier can fall out of the crib onto the floor or be tossed out of the crib by the child. U.S. Pat. 5,607,452 discloses a flexible clip for holding a single pacifier that can be affixed to a crib by a flanged flexible attachment. The flexible clip allows the child to pull the pacifier from the holder. A need exists for a device that can hold more than one pacifier so that a parent can simply pull a new pacifier from the device and place it in the child's mouth rather than having to search the crib, bedding and floor. A dispensing device would allow used pacifiers to be retrieved, cleaned and placed back in the dispenser. A further need exists for a dispenser that a child may learn to use without adult assistance alleviating the demands of a parent in responding to the cries of a child who has lost his or her pacifier. In the event the child pulls all of the pacifiers out of the dispenser, the parent may want to place the dispense out of reach. Therefore, a need exists for a pacifier dispenser that can be mounted in various locations at the parents discretion.

SUMMARY OF THE INVENTION

The present invention meets the needs and solves the problems identified above by providing an apparatus comprising a dispenser having a flanged tubular container removably engaged in a bracket The container has an interior space for holding pacifiers and a flexible gasket at the bottom of the container to retain the pacifiers in the container. The pacifiers are placed in the container wit the nipple facing downward. The body of the pacifier is held inside the container by the gasket. By grasping the pacifier at the side openings of the container and pulling downward, the gasket will deform and the pacifier will be released from the container. The gasket will return to its original shape and the next pacifier will be held until needed. The bracket may be fixedly mounted to a wall or it may be attached to a crib by a pair of velcro straps.

The foregoing and other objects, features and advantages of tie invention will be apparent from the following more particular description of a preferred embodiment of the invention, as illustrated in the accompanying drawings wherein like reference numbers represent like parts of the invention.

DESCRIPTION OF PREFERRED EMBODIMENTS

Figure 1:
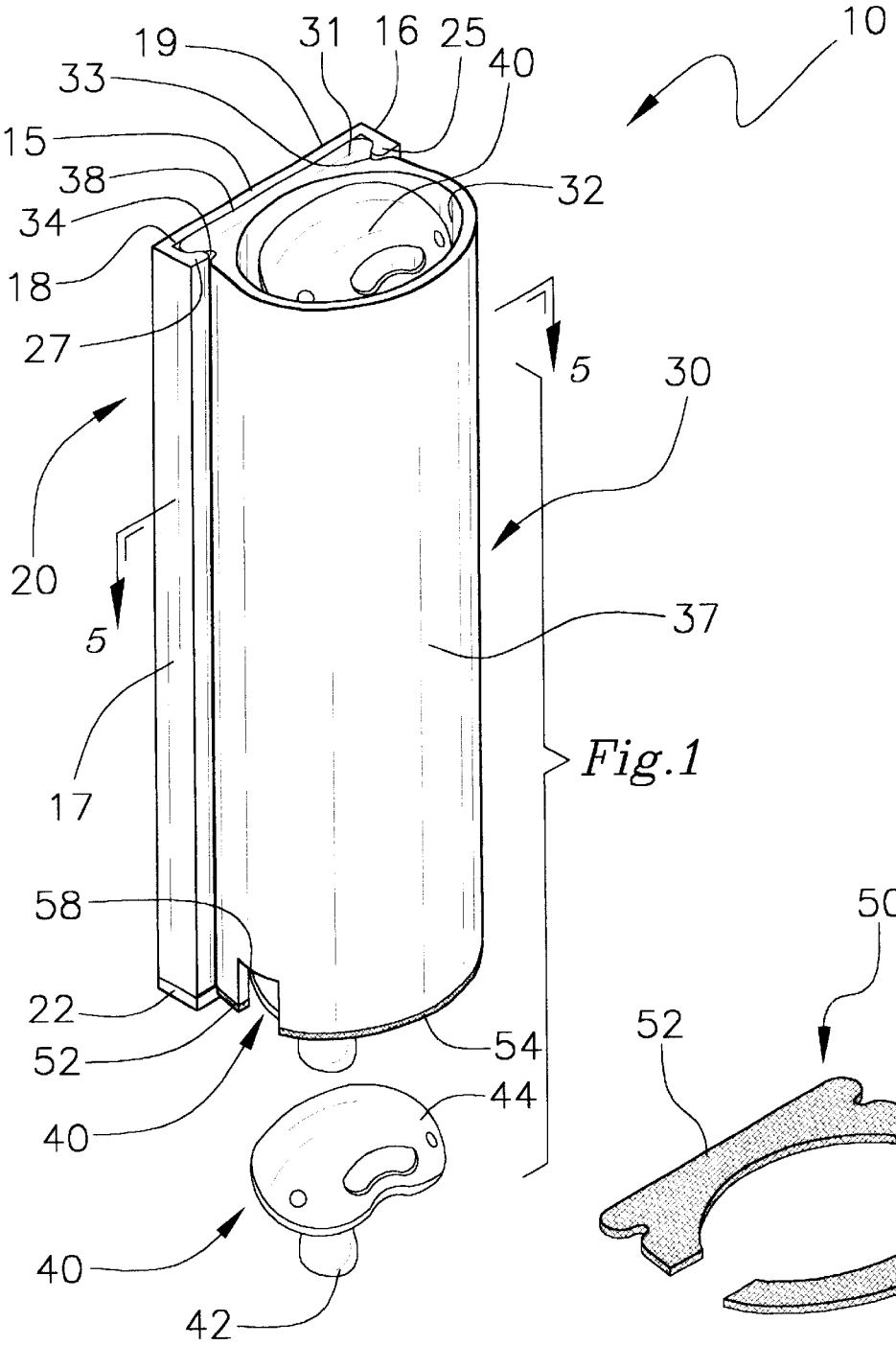
FIG. 1 is a left front perspective of the container in the bracket.

In FIG. 1, dispenser 10 has container 30 and bracket 20. Container 30 has front outer wall 37, rear outer wall 38, inner wall 32, top surface 31, rear gasket 52, front gasket 54, left notch 58 right notch 56 (see FIG. 3), left groove 34 and right groove 33. Inner wall 32 defines an elliptical inner cavity of container 30 for holding pacifiers 40. Left notch 58 and right notch 56 provide access to pacifier 40 and in particular to body 44 of pacifier 40. Pacifiers 40 are shown inside container 30 with body 44 facing up and nipple 42 facing down. Container 30 may be made from plastic, rubber or any suitable material that can be molded or extruded into the required shape.

Bracket 20 has bracket rear wall 15, left side 17, right side 16, left arm 27, right arm 25 and bottom 22. Bracket rear wall 15 has bracket rear wall outer surface 19 and bracket rear wall inner surface 18. Left arm 27 and right arm 25 are fixedly engaged to left side 17 and right side 16. Left side 17 and right side 16 are fixedly engaged to bracket rear wall 15. Bracket rear wall 15, left side 17, right side 16, left arm 27 and right arm 25 define a space for receiving container 30. When positioned inside bracket 20, container 30 has rear outer wall 38 adjacent to bracket rear wall inner surface 18. Left arm 27 and right arm 25 of bracket 20 engage left groove 34 and right groove 33 of container 30. In the preferred embodiment, bracket 30 is made from a suitable plastic.

Figure 2:
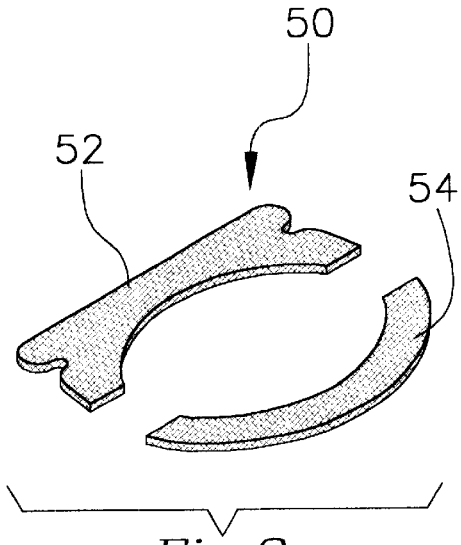
FIG. 2 is a perspective view of the gaskets.

FIG. 2 depicts rear gasket element 50 having rear gasket 52 and front gasket 54. Rear gasket 52 and front gasket 54 are made from any suitable flexible material that will deform when pressure is applied and return to the original shape when the pressure is removed. In the preferred embodiment, rear gasket 52 and front gasket 54 are made from rubber. However, rear gasket 52 and front gasket 54 may be made from any suitable material that will deform and return to its original shape. Rear gasket 52 and front gasket 54 are affixed to container 30 by glue, epoxy or other suitable adhesive.

Figure 3:
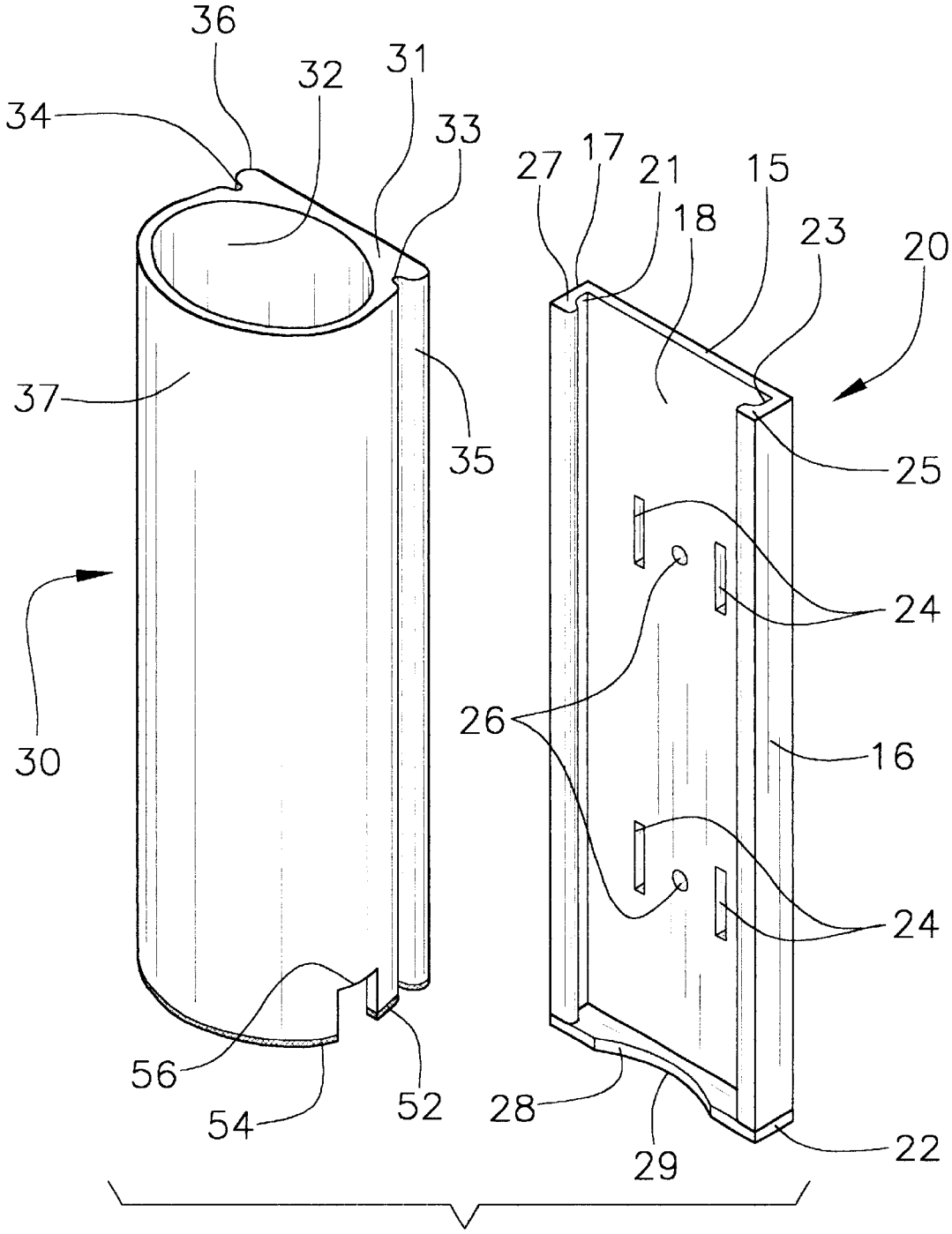
FIG. 3 is right front perspective of the container removed from the bracket.

FIG. 3 depicts container 30 removed from bracket 20. Bottom 22 of bracket 20 can be seen having bottom top surface 29 and bottom indent 28. Bottom top surface 29 prevents container 30 from sliding through bracket 20. When positioned inside bracket 20, container 30 has part of rear gasket 52 resting on bottom top surface 29 of bottom 22 of bracket 20. Bracket 20 has mounting holes 26 for receiving screws or bolts for affixing bracket 20 to a wall or other surface. Bracket 20 has strap slots 24 for receiving mounting straps 60 (see FIG. 4).

Figure 4:
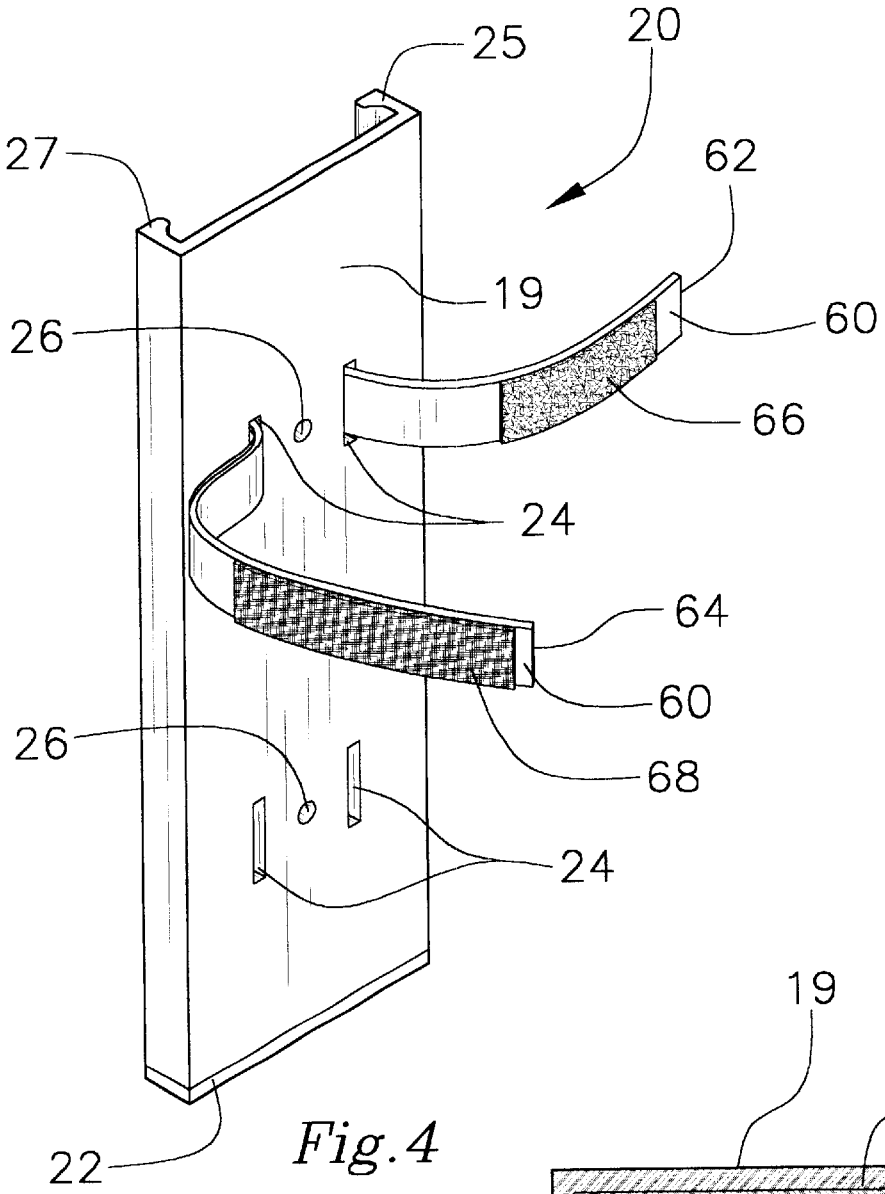
FIG. 4 is rear perspective view of the bracket.

FIG. 4 depicts bracket rear wall rear surface 19 of bracket 20. Bracket rear wall rear surface is flat and adapted for placement on a wall or suitable flat surface by securement devices such as screws placed in mounting holes 26. Mounting strap 60 is shown passing through strap slots 24 so that strap first end 62 and strap second end 64 are positioned for securing bracket 30 to a vertical post, slat or rod such as the posts or slats of a crib. Strap 60 has first attachment device 66 and second attachment device 68. In the preferred embodiment, first attachment device 66 and second attachment device 66 are hook and loop fasteners such as Velcro. Strap 60 is passed around the post, slat or rod to which bracket 20 is to be secured and first attachment device 66 and second attachment device 68 are engaged so that rear wall rear surface 19 contacts the post, slat or rod. Each adjacent pair of strap slots 24 holds one strap 60.

Figure 5:
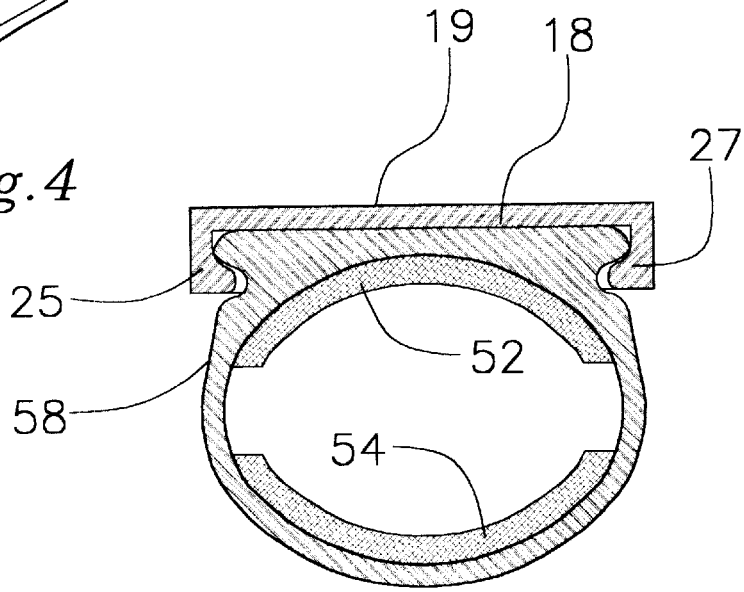
FIG. 5 is view along line 5—5 of FIG. 1.

FIG. 5 is a view of dispenser 10 along line 5—5 of FIG. 1. Left arm 27 and right arm 25 are shown engaging left groove 34 and right groove 33 of container 30. Rear gasket 52 and front gasket 54 are shown protruding inside the elliptical inner cavity defined by inner surface 32 of container 30 for holding pacifiers 40.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

I claim:

1. An apparatus for dispensing pacifiers having a body and a nipple comprising:

a bracket;

a container slidingly engaged in said bracket; and at least one gasket flexedly and fixedly engaged to said container;

wherein, a plurality of pacifiers are held within said container so that said body of said pacifier can be pulled through said gasket.

2. The container of claim 1 further comprising:

a container wall having an inner surface, an outer surface, a left notch and a right notch;

a rear wall fixedly engaged to said container wall; and a left groove and a right groove.

3. The bracket of claim 1 further comprising:

a rear wall;

a left side fixedly engaged to the rear wall;

a right side fixedly engaged to the rear wall;

a left arm fixedly engaged to said left side;

a right arm fixedly engaged to said right side;

a bottom fixedly engaged to said left side, said rear wall and to said right side;

a plurality of securement holes; and a plurality of strap slats.

4. The gasket of claim 1 further comprising:

a front gasket; and a rear gasket.

5. An apparatus for dispensing pacifiers having a body and a nipple comprising:

a bracket comprising;

a rear wall;

a left side fixedly engaged to the rear wall;

a right side fixedly engaged to the rear wall;

a left arm fixedly engaged to said left side;

a right arm fixedly engaged to said right side;

a bottom fixedly engaged to said left side, said rear wall and to said right side;

a plurality of securement holes; and a plurality of strap slats, a container slidingly engaged in said bracket, said container comprising;

a container wall having an inner surface, an outer surface, a left notch and a right notch;

a rear wall fixedly engaged to said container wall; and a left groove and a right groove, at least one gasket flexedly and fixedly engaged to said container, said gasket comprising;

a front gasket; and a rear gasket;

wherein, a plurality of pacifiers are held within said container so that said body of said pacifier can be pulled through said gasket.

6. A method of dispensing pacifiers comprising:

affixing a bracket to a surface;

positioning a plurality of pacifiers within a container;

sliding the container into the bracket; and extracting pacifiers.

* * * * *